US011169489B2

(12) United States Patent
Stranczl et al.

(10) Patent No.: US 11,169,489 B2
(45) Date of Patent: Nov. 9, 2021

(54) DYNAMIC CHRONOMETRIC TESTING

(71) Applicant: Montres Breguet S.A., L'Abbaye (CH)

(72) Inventors: Marc Stranczl, Nyon (CH); Rene Piguet, Cheseaux-sur-Lausanne (CH)

(73) Assignee: Montres Breguet S.A., L'Abbaye (CH)

( * ) Notice: Subject to any disclaimer, the term of this patent is extended or adjusted under 35 U.S.C. 154(b) by 393 days.

(21) Appl. No.: 16/195,883

(22) Filed: Nov. 20, 2018

(65) Prior Publication Data

US 2019/0171167 A1 Jun. 6, 2019

(30) Foreign Application Priority Data

Dec. 1, 2017 (EP) ..... 17204924

(51) Int. Cl.
*G04D 7/12* (2006.01)
*G04D 1/06* (2006.01)

(52) U.S. Cl.
CPC ..... *G04D 7/1264* (2013.01); *G04D 1/06* (2013.01); *G04D 7/1214* (2013.01)

(58) Field of Classification Search
CPC ..... G04D 1/06; G04D 7/006; G04D 7/1214; G04D 7/1264
USPC ..... 73/1.43, 1.52
See application file for complete search history.

(56) References Cited

U.S. PATENT DOCUMENTS

| | | | | |
|---|---|---|---|---|
| 2,841,978 A * | 7/1958 | Kohn | G04D 7/006 73/1.52 |
| 2,877,642 A * | 3/1959 | Mozur | G04D 7/009 73/1.52 |
| 2,926,519 A * | 3/1960 | Setterberg | G04D 7/009 73/1.52 |
| 10,228,661 B2 * | 3/2019 | Depraz | G04D 7/00 |

FOREIGN PATENT DOCUMENTS

| | | |
|---|---|---|
| CH | 695 197 A5 | 1/2006 |
| CH | 699 301 A1 | 2/2010 |
| CN | 106483831 A | 3/2017 |
| FR | 2060033 | 6/1971 |
| JP | 2017-96914 A | 6/2017 |

OTHER PUBLICATIONS

European Search Report dated May 31, 2018 in European Application 17204924.9 filed on Dec. 1, 2017 (with English Translation of Categories of Cited Documents).
Combined Chinese Office Action and Search Report dated Jul. 8, 2020, in Patent Application No. 201811432479.0 (with English translation), 16 pages.
Japanese Office Action dated Jan. 12, 2021 in Japanese Patent Application No. 2020-030747, 11 pages.

* cited by examiner

*Primary Examiner* — Daniel S Larkin
(74) *Attorney, Agent, or Firm* — Oblon, McClelland, Maier & Neustadt, L.L.P.

(57) ABSTRACT

A dynamic chronometric testing of a movement or of a watch, control device fine controlling a predefined or random cycle of movements via standardised chronometric (Continued)

testing positions, the rate parameters are also measured in dynamic positions where the acceleration and velocity are different to zero and which correspond to additional dynamic chronometry criteria, defined to qualify the rate during a continuous movement applied to the movement or respectively to this watch.

14 Claims, 2 Drawing Sheets

DYNAMIC CHRONOMETRIC TESTING

CROSS-REFERENCE TO RELATED APPLICATION

This application claims priority to European Patent Application No. 17204924.9 filed on Dec. 1, 2017, the entire disclosure of which is hereby incorporated herein by reference.

FIELD OF THE INVENTION

The invention relates to a device for the chronometric testing of a watch movement, or watch, said device including at least one receptacle arranged to hold, up to a given acceleration threshold, at least one watch movement or a watch, and including handling means arranged to handle each said receptacle spatially, arranged to apply to each said receptacle at least one predefined or random cycle in respect of the path thereof and the dynamic evolution thereof along this path under the fine control of control means including a clock or connected to an external time base, said cycle including the passage via standardised chronometric testing positions.

The invention also relates to a method for the dynamic chronometric testing of a watch movement, or watch.

The invention relates to the field of chronometric testing for moving watchmaking parts, watches and chronometers for maritime or on-board use.

BACKGROUND OF THE INVENTION

Chronometric testing of a watchmaking part, particularly a watch, or the movement thereof, is vital in order to check the quality of the product supplied to the user. This testing is governed by official certification standards, drafted by recognised laboratories or observatories, which are essential for the marketing of products.

Current chronometric testing measures the properties of the watch in static positions. Conventionally, static testing is performed in six testing positions, two horizontal and four vertical.

Designers focus, additionally, on various intermediate spatial positions, which appear to be more representative of the actual wearing of a watch. For example, the collective publication "Théorie d'horlogerie" by Reymondin, Monnier, Jeanneret, Pelaratti, published by FET (Federation of Technical Schools) in Switzerland, page 158, figure 7.85, cites in the vertical 8 o'clock up position with a 30° inclination.

The paper from the 2007 International Congress of Chronometry, in Colombier (Switzerland), page 45, released by Meissner, Pellet, Müller, Gemise, Meylan, thus reports on automated measurement cycles in the six reference positions, plus the intermediate positions at 45°.

The "cyclotest" device is a machine used to wind and keep wound mechanical watches with an automatic winding system. The watch is positioned on a rotary device which keeps it continuously in a dynamic motion. The watch tends to lose time when it is placed on this device. This device is used routinely by horologists to keep the watch operational. Typically, the horologist notes the time of the watch and a reference time, places the watch on the "cyclotest" device or in a static position on his/her bench typically for 24 hours, notes the reference time and the displayed time once again and infers the rate drift of the watch (this measurement corresponds to the daily rate).

The document EP 3 136 189 A1 in the name of ROLEX describes a chronometric measurement method and more particularly relative to the positions wherein the watch or watch head is positioned during the measurement. The chronometric testing simulates, via static positions, the various positions of the watch during a day of typical use.

The document CH695197A5 in the name of TAG HEUER describes a watch qualification method, including the following steps:

selecting a test sequence from a plurality of predetermined test sequences, with at least two separate tests suitable for verifying whether said watch meets the requirements of a qualification level selected from a qualitative range comprising at least three separate discrete qualitative levels, setting a plurality of predefined test parameters on stock including a plurality of configurable test devices, these parameters being dependent on the test sequence selected, and these test devices being suitable for performing on a complete watch and/or on a watch element at least two separate tests from the following tests: abrasion test, water-resistance test, functional test of external watch organs, of which the push-buttons and/or the clasp, and/or the rotating bezel and/or the crown, test of resistance to mechanical fatigue due to pulling, torsion, deflection, bending, repetitive shocks, shearing, compression and/or tearing, vibration test, acceleration and/or shock test, climatic test, pull test, ultraviolet radiation resistance test, ozone resistance test, solvent agent resistance test, corrosion resistance test using saltwater, chlorinated water and/or sweat, running, using the configured test devices, the test program corresponding to the test sequence selected, assigning to the watch tested the qualification level according to the result of each of the tests performed.

The document CH699301A1 in the name of METALLO TESTS describes a test device for a watch movement, including a support suitable for receiving at least one watch movement for a plurality of reliability tests, this support including at least one opening and being suitable for being positioned in various reliability test modules, at least one measurement sensor associated with the watch movement, the measurement sensor being suitable for measuring indicative values of various parameters of the watch movement during a test method relative to these parameters; and a carrier element suitable for carrying the watch movement, this carrier element being attachable to the support in order to close the opening so as to enclose the watch movement and the measurement sensor inside the support.

The document EP10192725 in the name of The Swatch Group Research & Development Ltd describes chronometric qualifications using optical methods.

SUMMARY OF THE INVENTION

The invention aims to define chronometric testing criteria for specifically qualifying the watches produced, and to set up suitable testing tools and methods.

To this end, the invention relates to a device for dynamic chronometric testing of a watch movement, or watch.

The invention further relates to a method for dynamic chronometric testing of a watch movement, or watch.

BRIEF DESCRIPTION OF THE FIGURES

Further features and advantages of the invention will emerge on reading the detailed description hereinafter, with reference to the appended figures, wherein.

DETAILED DESCRIPTION OF PREFERRED EMBODIMENTS

Figure 1:
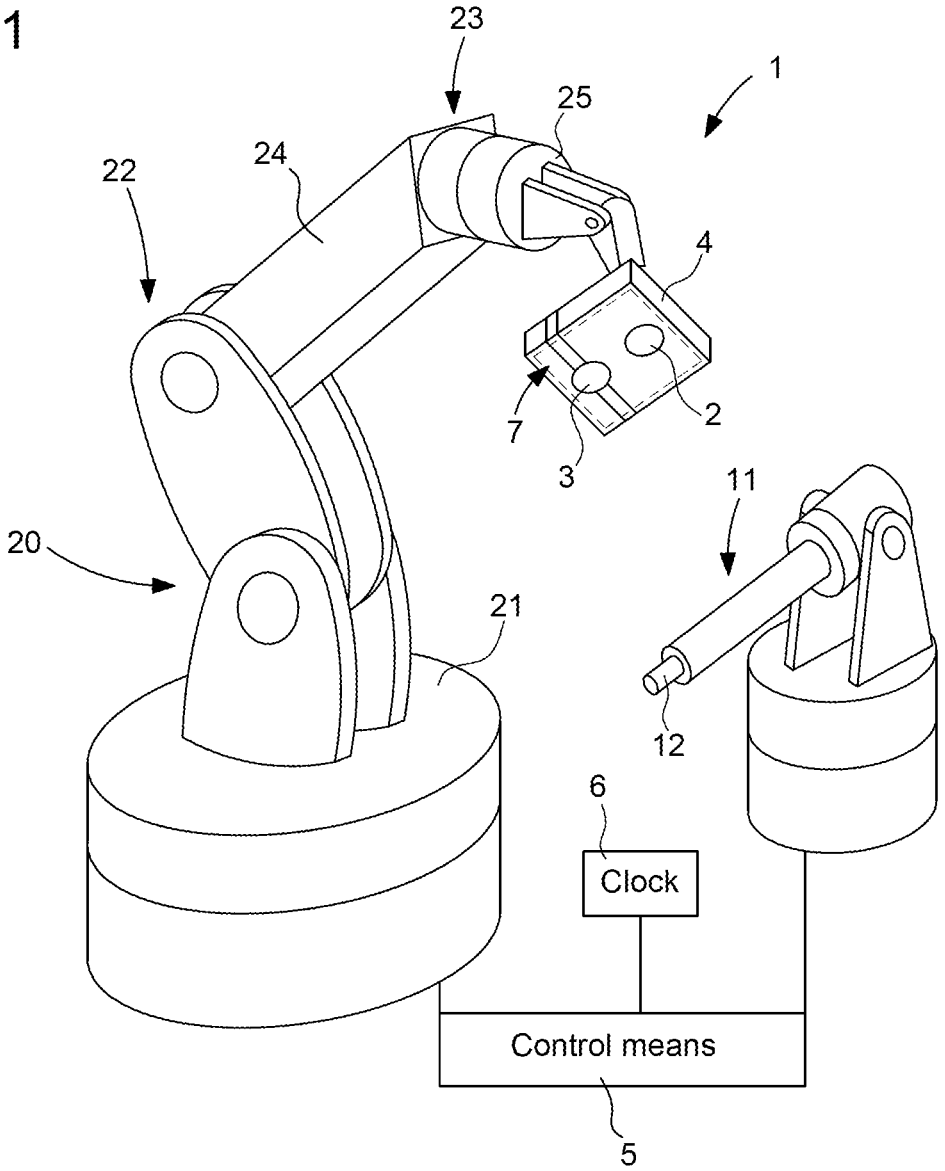
FIG. 1 represents, schematically, multi-axis handling means, in the form of a robot simulating a user's upper limb, with shoulder and elbow joints, and, at the level of the wrist, a receptacle for holding a timepiece movement or a watch for which it is sought to conduct chronometric testing, the robot is herein interfaced with a second manipulator which bears adjustment setting means, suitable for cooperating directly with this movement or this watch for the rate adjustment thereof.

The invention proposes to differentiate the standard static positions, and dynamic movements, and, to this end, define a chronometry criterion corresponding to a "dynamic position" concept.

It is understood that, in the course of the same day, a watch that is worn by a user, may occupy sometimes prolonged static positions (for example placed on desk during the day, or on a bedside table at night, or during the day when the wearer is reading a book or is not physically active, while travelling for example) and may occupy an infinity of positions at other times, during phases in which the watch is constantly changing position, for example when the wearer is walking: this "dynamic position" concept corresponds to this continuous motion.

By analogy, the approach according to the invention may be simplified, by envisaging a watch placed in a ride such as a roller coaster, which is at rest 12 hours per day in the vertical position, and completes loop-the-loops for the remaining 12 hours (with statistically: 6 hours with the head right-side up, and 6 hours with the head upside down).

A conventional chronometric certification would consist of certifying the rate as follows:

18 hours in the "pendant up" position, corresponding to the total of the 12 hours of rest and the 6 hours during which statistically the watch is in this position during the loop-the-loops);

6 hours in the "pendant down" position, corresponding to the 6 hours in which the watch is statistically in this position during the loop-the-loops: and the watch should in this case not exhibit drift of more than ±2 seconds per day.

Whereas a "dynamic position" type certification according to the invention would consist of certifying the rate as follows:

12 hours in the "pendant up" position;

12 hours in the "dynamic position" (such as loop-the-loop): and the watch must not exhibit drift greater than a certain value, of more than ±x seconds per day.

It is necessary to define this "dynamic position", particularly according to the following points:

a reading with an accelerometer on the wrist provides a reading of the accelerations sustained by the watch. It is possible to define a criterion, for example an acceleration threshold, which makes it possible to differentiate static positions from dynamic movements;

the static positions are weighted according to the six standard timepiece positions;

the dynamic position(s) may be defined according to the accelerations recorded on wearers. For example, a dynamic position may reproduce accurately the movement of a watch when the wearer is walking. A further dynamic position may reproduce all other random daytime movements (getting dressed, drinking, eating, or the like, etc.);

in the dynamic position, the watch is constantly in motion or accelerated, without for all that being merely a succession of static positions;

this dynamic position is also valid for watches without automatic winding;

the precise movement applied to the watch may be, as desired, programmed, or completely random;

the precise movement may be set and defined specifically. For example, the watch may be on a "cyclotest" device with which the path of the watch is known;

the movement may reproduce statistical use, and may also include mandatory passage via certain configurable predefined intermediate positions;

the movement velocity applied may be variable or constant;

the variation of further physical parameters, such as non-restrictively the temperature and atmospheric pressure, or the hygrometry, or the like, may be combined with the movements applied to the movement or the watch; and the chronometric properties (rate and amplitude) may be measured continuously on the dynamic device, or via state measurement (time reading) before and after the period in the "dynamic position".

The invention thereby makes it possible to characterise the chronometric properties of the watch more accurately and more faithfully in respect of the customer's use/need.

The invention thus relates to a device 1 for the dynamic chronometric testing of a watch movement 2, or of a watch 3. This device 1 includes at least one receptacle 4, which is arranged for the safe holding, up to a given acceleration threshold, of at least one movement 2 or watch 3.

The device 1 includes multi-axis handling means 20, which are arranged to handle each said receptacle 4 spatially, and which are arranged to apply to each receptacle 4 at least one predefined or random cycle in respect of the path thereof and the dynamic evolution thereof along this path under the fine control of control means 5 including a clock 6 or connected to an external time base.

This cycle, particularly when it is predefined, includes the passage via standardised chronometric positions, particularly but non-restrictively the six standardised chronometric positions, such as the "COSC Official Swiss Chronometer Testing Institute", or by the positions required for equivalent guidelines: Geneva Observatory of Chronometry, Besancon Observatory, Hamburg Observatory, former Neuchâtel Observatory of Chronometry, or similar.

The handling means 20 are arranged for the continuous spatial handling of each receptacle 4, and the device 1 includes rate sensor means 7, which are arranged for the continuous and dynamic recording of the rate parameters of each movement 2 (or watch 3) placed in the receptacle 4 during a movement or/and an acceleration. This continuous recording, specific to the invention, is correlated with the recording of the rate parameters, and the physical conditions of the environment wherein the chronometric testing takes place. This continuous handling does not necessarily imply continuous motion of the receptacle 4, which may adopt static positions during the cycle.

The device 1 includes fine control means 10 and analysis means 9 interfaced with the control means 5, the rate sensor means 7, and the environment sensor means 8, and which are arranged to evaluate the behaviour upon wearing of each movement 2 or respectively of each watch 3. These fine control 10 and analysis means 9 are further arranged to issue a testing certificate in the case where all the values measured comply with predefined tolerances, or to resume an iterative rate setting correction and testing process otherwise, for both standardised static positions and dynamic positions where the acceleration and velocity are different to zero and which correspond to additional dynamic chronometry criteria, defined in order to qualify the rate during continuous motion applied to the movement 2, or respectively to the watch 3.

These fine control means 10 include storage means 30, which are arranged to store parameters in respect of tolerances, value thresholds, or/and to store parameters in respect of duration and physical conditions representative of specific typical wear scenarios, and are to this end advantageously coupled with these environment sensor means 8 and with environment generating means, which are arranged to apply specific physical conditions where the measurement is taking place: temperature, hygrometry, magnetic field, or the like.

More particularly, these multi-axis handling means 20 are arranged to handle each receptacle 4 spatially according to at least two degrees of freedom simultaneously.

More particularly, the device 1 includes rate setting means 11, and the fine control means 10 are arranged to send control signals to actuators 12 included in the rate setting means 11, to correct the rate of adjustment means 13 included in a resonator of the movement 2 or respectively of the watch 3, before proceeding with at least one new predefined or random test cycle.

In one alternative embodiment, the fine control means 10 include a display suitable for communicating to a horologist technician the instructions for setting the resonator of the movement 2 or watch 3.

More particularly, the fine control means 10 are arranged to issue, when all the tests performed meet the predefined chronometric criteria, both static and dynamic, a document which is the chronometry certificate of the movement 2 in question (or of the watch 3 depending on the case).

More particularly, these rate sensor means 7, and the environment sensor means 8 are arranged to subject the movement 2 or respectively the watch 3, to additional predefined or random validation tests.

More particularly, the fine control means 10 are arranged to control the multi-axis handling means 20 so as to simulate the movements of the arm or/and forearm or/and hand of a right-handed or left-handed user, with angular amplitudes limited to the natural angular amplitudes at the level respectively of the shoulder, elbow, wrist.

More particularly again, these fine control means 10 are arranged to control the multi-axis handling means 20 so as to generate a resultant movement of the movement 2 or respectively of the watch 3, along a set surface or a sphere or an ellipsoid or a hyperboloid.

In one advantageous alternative embodiment, these fine control means 10 include means for generating random numbers 14, which are arranged, either to assign a random value to a fine control program parameter, or to intervene in the progress of the fine control program by triggering a further movement, and which are arranged to trigger the switching, at random times, of the predefined cycle, to apply to the movement 2 or respectively to the watch 3 a path according to a random velocity or/and according to a random acceleration or/and according to random modulus or/and direction or/and random direction movement vectors, along travels limited to a predefined envelope volume.

More particularly, these means for generating random numbers 14 are arranged to apply to the fine control means 10 a random duration of this switching.

In one alternative embodiment, the fine control means 10 are arranged to resume the predefined or random cycle according to the position reached upon switching, from the end of switching. In one particular alternative embodiment, the end of the switching is managed by the clock 6 of the device 1.

In one particular embodiment, the multi-axis handling means 20 include at least one multi-axis robot 21 which includes, between a shoulder joint 22 and an elbow joint 23 restricted to the same angular travels as the human arm, an upper robot arm 24 of similar dimensions to those of a human arm, and at a distal part beyond the elbow 23, a lower arm 25 of similar dimensions to those of a human forearm and wearing, in the vicinity of the distal end thereof, the movement 2 or respectively the watch 3. More particularly, this multi-axis robot 21 includes three axes at the level of the shoulder joint 22 (abduction-adduction movements in the frontal plane, and flexion-extension in the sagittal plane), and at least one axis at the level of the elbow joint 23. However, complex supination and pronation movements of the forearm, in the transversal plane, may be approximated, in relation to the resulting effect for a watch 3 worn on the forearm abutting against the ulnar protuberance, by three robot axes at the level of the elbow. A conventional commercial 6-axis robot is therefore suitable for the dynamic chronometric testing application.

In one alternative embodiment, the fine control means 10 include storage means 30, which are arranged to store parameters in respect of tolerances, angular clearance thresholds, velocity thresholds, acceleration thresholds, or/and the storage means 30 are arranged to store a kinematic sequence recorded according to the movements of a typical user, or/and a programmed kinematic sequence.

In a further alternative embodiment, each receptacle 4 includes at least one inertial sensor including at least one accelerometer arranged to measure acceleration applied to the movement 2 or respectively to the watch 3, and distinguish static positions where the acceleration and the velocity are zero and among which are the standardised chronometric testing positions, particularly the six standardised chronometric testing positions, and dynamic positions where the acceleration and the velocity are different to zero and which correspond to additional dynamic chronometry criteria.

More particularly, and not restrictively, the rate sensor means 7 are acoustic, such as a microphone or the like, or are optical, such as a camera.

In one particular alternative embodiment, the rate setting means 11 include a robotic manipulator, suitable for intervening by screwing a regulator screw, moving or/and rotating a balance-spring stud, by deforming or moving limiting pins of the working part of a balance-spring, by the action of a laser beam on a balance-spring or on a balance, or the like.

Figure 3:
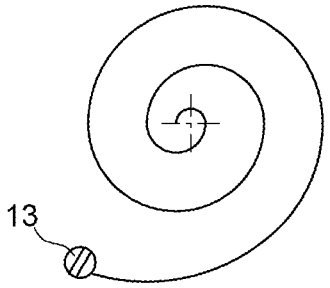
FIG. 3 represents, schematically, a balance-spring stud for fastening the outer coil of the balance-spring of a resonator, with an eccentric setting screw suitable for being adjusted by the second manipulator in FIG. 1.
Figure 2:
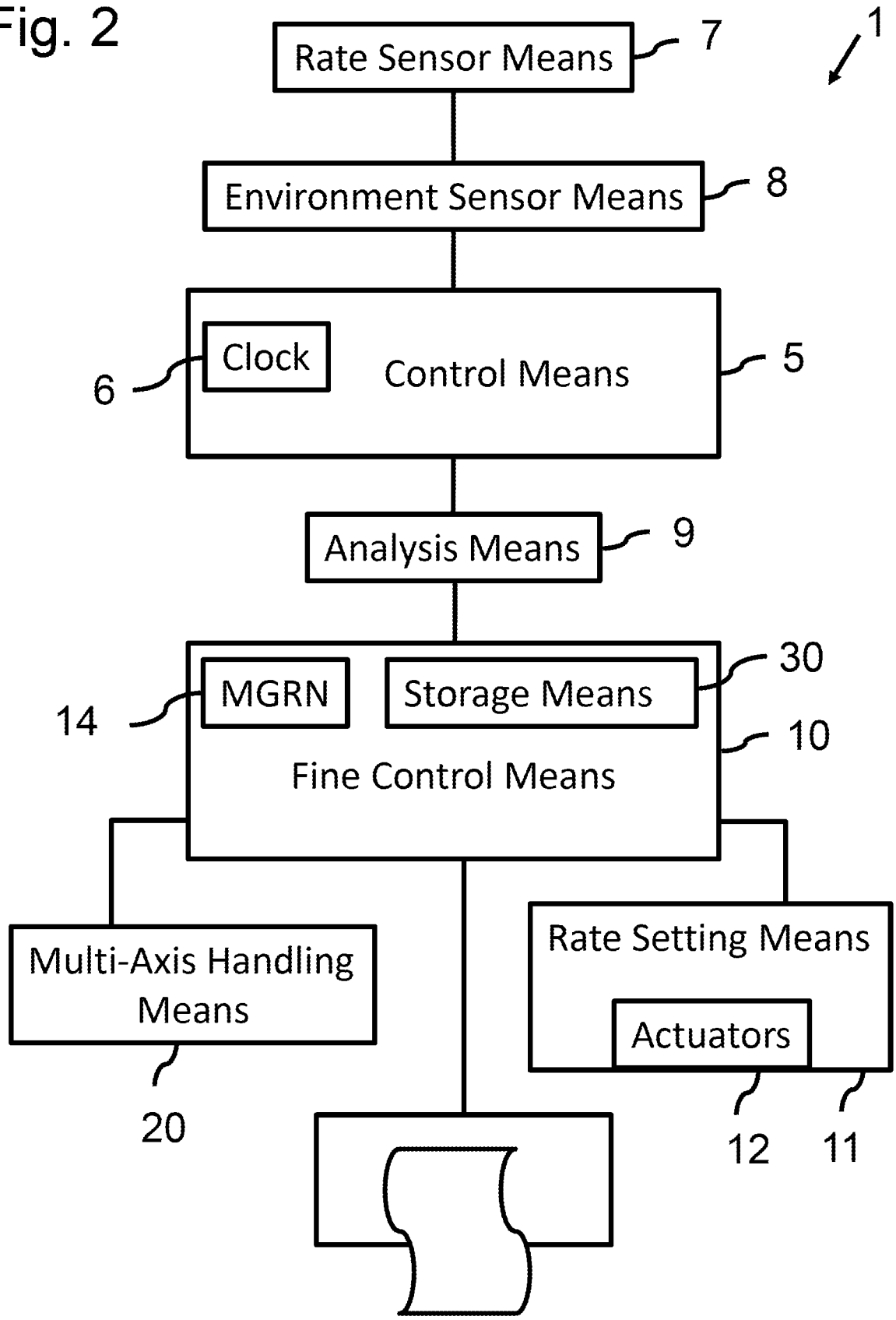
FIG. 2 is a block diagram presenting a data bus and the various fine control, testing, analysis, time base, control circuits, for performing the rate testing and issuing a certificate in the final stage after completing the iterative testing and setting process, and obtaining static testing and dynamic testing results all within predefined tolerances.

FIG. 3 illustrates an example of setting on a balance-spring stud for fastening the outer coil of the balance spring of a resonator, with an eccentric setting screw suitable for being adjusted by a second manipulator, which differs from the conventional procedure whereby inertia-blocks or screws tend to be set on the balance to set the inertia and the unbalance.

The invention further relates to a method for the dynamic chronometric testing of a watch movement 2, or of a watch 3, whereby spatial movements are applied to the movement 2 or respectively to the watch 3, during at least one testing cycle. These movements include at least one predefined or random cycle in respect of the path thereof and the dynamic evolution thereof along this path under the fine control of control means 5 including a clock 6 or connected to an external time base. This predefined cycle includes the passage via standardised chronometric positions, particularly the six standardised chronometric testing positions.

The rate parameters (rate and amplitude) of the movement 2, or respectively of the watch 3, are measured in the six positions and in further programmed or/and random intermediate positions.

Continuous chronometric testing of the movement 2, or respectively of the watch 3 is carried out, and the rate parameters of the movement 2, or respectively of the watch 3 are recorded continuously and dynamically, comparing the rate parameters with the set-point values.

A testing certificate is issued if all the values measured comply with predefined tolerances, or an iterative rate setting correction and testing process is resumed otherwise.

According to the invention, the acceleration applied to the movement 2, or respectively to the watch 3 is measured, distinguish static positions where the acceleration and the velocity are zero and among which are the standardised chronometric testing positions, and dynamic positions where the acceleration and the velocity are different to zero and which correspond to additional dynamic chronometry criteria, defined to qualify the rate during a continuous movement applied to the movement 2 or respectively to the watch 3.

More particularly, during at least a part of the testing cycle, spatial movements are applied to the movement 2, or respectively to the watch 3, according to at least two degrees of freedom simultaneously.

More particularly, the handling of the movement 2, or respectively of the watch 3, is programmed by learning on the basis of movement recorded on a test user, for a daily duration.

In one alternative embodiment, random movements of the movement 2, or respectively of the watch 3 are generated, in order to apply thereto dynamic positions wherein additional dynamic chronometry testing is performed.

In one particular alternative embodiment, the same receptacle 4 contains a plurality of movements 2 or watches 3, is arranged to be handled by a robot, and includes positioning guide-marks for the precise identification of the spatial positioning thereof, and includes orifices arranged for inserting sensors and/or setting means.

In sum, the invention enables better knowledge of the behaviour of a timepiece movement or of a watch throughout all the phases of the use thereof. The additional testing performed with respect to conventional guidelines have a noteworthy return in favour of the user. The design of a device 1 according to the invention makes it possible to carry out useful testing operations which were hitherto non-productive transition phases, and enhances the overall quality supplied to customers.

Advanced automation of this production-testing station makes it possible, also, to carry out thorough testing of the rate of a timepiece movement on the basis of the dynamic positions alone, indeed, the supply of a certificate based on static positions is not always required, and it is then not necessary to immobilise the movement or the watch for the corresponding duration, as the dynamic chronometric testing represents an excellent means to qualify production.

The invention claimed is:

1. A device configured for dynamic chronometric testing of a watch movement or watch, said device comprising at least one receptacle arranged to hold, up to a given acceleration threshold, at least one movement or a watch, and including multi-axis handling means arranged to handle each said receptacle spatially, arranged to apply to each said receptacle at least one predefined or random cycle in respect of a path thereof and dynamic evolution thereof along the path under the control of a fine control circuit including a clock or connected to an external time base, said cycle including passage via standardised static chronometric testing positions, wherein said multi-axis handling means are arranged for continuous spatial handling of each said receptacle, and said device includes rate sensor means for the continuous and dynamic recording of rate parameters of each movement placed in said receptacle during at least one of a movement and an acceleration, correlated with an environment sensor for continuous recording, relative to said recording of the rate parameters, of physical conditions of the environment wherein said chronometric testing takes place, and said device includes the fine control circuit interfaced with said rate sensor means, and said environment sensor, and arranged to evaluate behaviour upon wearing of each said movement or respectively of each said watch, to issue a testing certificate in the case where all values measured comply with predefined tolerances, or to resume an iterative rate setting correction and testing process otherwise, for both dynamic positions and said standardised static chronometric testing positions where the acceleration and velocity are different than zero and which correspond to additional dynamic chronometry criteria, defined in order to qualify the rate during continuous motion applied to said movement or respectively to said watch, said multi-axis handling means are configured to simulate movements of at least one of an arm, forearm and of a right-handed or left-handed user, with angular amplitudes limited to natural angular amplitudes at a level respectively of a shoulder, elbow, wrist, and said multi-axis handling means are configured to switch, at random times of said at least one predefined cycle, to apply to said movement or respectively to the watch a path according to at least one of a random velocity a random acceleration, random modulus, random direction, and random direction movement vectors, along travels limited to a predefined envelope volume.

2. The device according to claim 1, wherein said multi-axis handling means are arranged to handle each said receptacle spatially according to at least two degrees of freedom simultaneously.

3. The device according to claim 1, wherein said device includes rate setting means, and wherein said fine control circuit is arranged to send control signals to actuators included in said rate setting means, the actuators being arranged to correct a rate of adjustment means included in a resonator of said at least one movement or respectively of said at least one watch, before proceeding with at least one new said at least one predefined or random test cycle.

4. The device according to claim 1, wherein said rate sensor means and said environment sensor are arranged to subject said at least one movement or respectively said at least one watch, to additional predefined or random validation tests.

5. The device according to claim 1, wherein said said multi-axis handling means are configured to generate a resultant movement of said at least one movement or respectively of said at least one watch, along a set surface or a sphere or an ellipsoid or a hyperboloid.

6. The device according to claim 1, wherein said fine control produces a random duration of said switching.

7. The device according to claim 6, wherein said multi-axis handling means are controlled to resume said at least one predefined or random cycle according to a position reached upon switching, from the end of said switching.

8. The device according to claim 1, wherein said multi-axis handling means comprise at least one multi-axis robot including, between a shoulder joint and an elbow joint restricted to the same angular travels as a human arm, an upper robot arm of similar dimensions to those of the human arm, and at a distal part beyond elbow joint, a lower arm of similar dimensions to those of a human forearm and wearing, in a vicinity of an end of the distal part thereof, said at least one movement or respectively said at least one watch.

9. The device according to claim 8, wherein said multi-axis robot comprises three axes at a level of said shoulder joint, and three axes at a level of said elbow joint.

10. The device according to claim 1, wherein said fine control comprises a storage device arranged to at least one of:

store parameters in respect of tolerances, angular clearance thresholds, velocity thresholds, acceleration thresholds, and store a kinematic sequence recorded according to one of movements of a user and a programmed kinematic sequence.

11. The device according to claim 1, wherein said receptacle comprises at least one inertial sensor including at least one accelerometer arranged to measure acceleration applied to said at least one movement or respectively to said at least one watch, and distinguish static positions where the acceleration and the velocity are zero and among which are the standardised chronometric testing positions, and dynamic positions where the acceleration and the velocity are different than zero and which correspond to additional dynamic chronometry criteria.

12. A method for dynamic chronometric testing of a watch movement, or of a watch, comprising:

applying movements to said movement, or respectively to said watch, including at least one predefined or random cycle in respect of a path thereof and dynamic evolution thereof along the path under fine control based upon a clock or an external time base, said at least one cycle including a passage via standardised chronometric testing positions, measuring rate parameters of said movement or respectively of said watch in said standardised positions and in at least one of further programmed and random intermediate positions, wherein continuous chronometric testing of said movement or respectively of said watch is carried out, recording the rate parameters of said movement or respectively of said watch continuously and dynamically, comparing said rate parameters with set-point values, issuing a testing certificate if all values measured comply with predefined tolerances, or an iterative rate setting correction and testing process is resumed otherwise, measuring acceleration applied to said movement or respectively to said watch, to distinguish static positions where the acceleration and the velocity are zero and among which are said standardised chronometric testing positions, and dynamic positions where the acceleration and the velocity are different than zero and which correspond to additional dynamic chronometry criteria, defined to qualify the rate during a continuous movement applied to said movement or respectively to said watch, and generating random movements of said movement or respectively of said watch in order to perform, at said dynamic positions, additional dynamic chronometry testing.

13. The method for the dynamic chronometric testing of a watch movement, or of a watch, according to claim 12, wherein, during at least a part of a testing cycle, spatial movements are applied to said movement or respectively to said watch, according to at least two degrees of freedom simultaneously.

14. The method for the dynamic chronometric testing of a watch movement, or of a watch, according to claim 12, wherein handling of said movement or respectively of said watch is programmed by learning on the basis of movement recorded on a test user, for a daily duration.

* * * * *